US006964632B1

(12) United States Patent
Ko

(10) Patent No.: US 6,964,632 B1
(45) Date of Patent: Nov. 15, 2005

(54) LIFTING MECHANISM FOR AN EXERCISE APPARATUS

(76) Inventor: Chen-Hui Ko, No.342, Ta Tung Road, Koeishan Hsiang, Taoyuan Hsien (TW)

( * ) Notice: Subject to any disclaimer, the term of this patent is extended or adjusted under 35 U.S.C. 154(b) by 0 days.

(21) Appl. No.: 10/883,660

(22) Filed: Jul. 6, 2004

(51) Int. Cl.[7] ..... A63B 22/02
(52) U.S. Cl. ..... 482/54
(58) Field of Search ..... 482/51–54, 140, 482/142, 148, 908; 601/23, 24, 34–36

(56) References Cited

U.S. PATENT DOCUMENTS 5,378,212 A * 1/1995 Pin-Kuo ..... 482/54
5,674,156 A * 10/1997 Watterson et al. ..... 482/54
5,855,537 A * 1/1999 Coody et al. ..... 482/54
6,719,669 B1 * 4/2004 Wang et al. ..... 482/54
6,730,002 B2 * 5/2004 Hald et al. ..... 482/51
6,761,667 B1 * 7/2004 Cutler et al. ..... 482/54
6,811,518 B2 * 11/2004 Lin ..... 482/54
6,811,519 B2 * 11/2004 Kuo ..... 482/54

* cited by examiner

*Primary Examiner*—Stephen R. Crow
*Assistant Examiner*—Tam Nguyen
(74) *Attorney, Agent, or Firm*—Rosenberg, Klein & Lee

(57) ABSTRACT

A lifting mechanism for an exercise apparatus having a reduction gearset and a driving gear meshing with the reduction gearset within a housing wherein the driving gear includes an axial threaded hole and an axial bearing. A spindle passes through the housing and the axial bearing and engages the axial threaded hole of the driving gear. Meanwhile, a socket corresponding to the spindle is installed on the external side of the housing. The housing is made of lightweight material. Moreover, a first and a second piece for supporting the spindle are made of high strength material and fastened on both external sides of the housing by metal screws, thereby forming a supporting frame with high strength and light weight.

3 Claims, 5 Drawing Sheets

LIFTING MECHANISM FOR AN EXERCISE APPARATUS

BACKGROUND OF THE INVENTION

1. Field of the Invention

The invention relates to a lifting mechanism for an exercise apparatus, and more particularly, to a lifting mechanism that makes a linear telescopic motion rather than a spiral rotation. Moreover, the unloaded portion of the lifting mechanism is made of lightweight material to meet the requirements on weight and strength.

2. Description of the Related Art

Most of the conventional exercise apparatuses includes a lifting mechanism to adjust its inclination relative to a horizontal plane. In order to facilitate the operation thereof, a motor is employed to drive a reduction gearset for imparting rotational motion to a lifting element. In this way, a desired angle is achieved.

As shown in FIG. 1, a lifting mechanism 80 for a treadmill 60 includes a motor 81 that drives a reduction gearbox 82 pivotally attached to a tread base 61 to bring a spindle 83 in rotation. The spindle 83 is telescopic within an elongated socket 84 with its bottom end pivotally attached to a base frame 62. The lifting mechanism 80 features that the height above the socket 84 is adjustable by rotating the spindle 83, thereby undergoing a folding or an unfolding action of the tread base 61. The supporting force required grows in proportion as the inclination of the tread base 61 increases and the contact area between the spindle 83 and the socket 84 decreases. Due to the restricted space between the tread base 61 and the base frame 62, the extension of the spindle 83 is limited to a certain extent. Therefore, the torque of the whole spindle 83 is concentrated at the top 841 of the socket 84, thereby resulting in vibration of the tread base 61 and even malfunction thereof. Thus, the service life thereof is reduced. Besides, the spindle 83 during its rotation is exposed to the outside, and this would endanger the operator or others around him. In addition, it's not easy to cover the spindle 83 for a greater safety since it undergoes the extending or the retracting action. Meanwhile, it's difficult and costly to cut a screw thread into the inner wall of the socket 84.

In order to eliminate the above-mentioned disadvantages, the inventor of the invention has tried to install a rotational socket with which the spindle makes a linear telescopic motion without rotation. This has been proved applicable. However, the reduction gearbox 82 must have a sufficient strength to withstand the torque created by the spindle. Therefore, the reduction gearbox 82 must be made of metal material, and this will increase the whole weight thereof, thereby affecting the installation and movement of the treadmill. Moreover, the production cost of the treadmill is increased in addition to its weight.

SUMMARY OF THE INVENTION

It is a primary object of the invention to eliminate the aforementioned drawbacks and to provide a lifting mechanism for an exercise apparatus that includes a telescopic spindle moving in a non-rotation way and makes an axial to-and-fro movement by means of a driving gear within a reduction gearset for a greater stability and safety.

It is another object of the invention to provided a lifting mechanism for an exercise apparatus whose weight is considerably reduced while its strength is still maintained.

BRIEF DESCRIPTION OF THE DRAWINGS

The accomplishment of this and other objects of the invention will become apparent from the following descriptions and its accompanying drawings of which.

DETAILED DESCRIPTION OF THE PREFERRED EMBODIMENT

Figure 1:
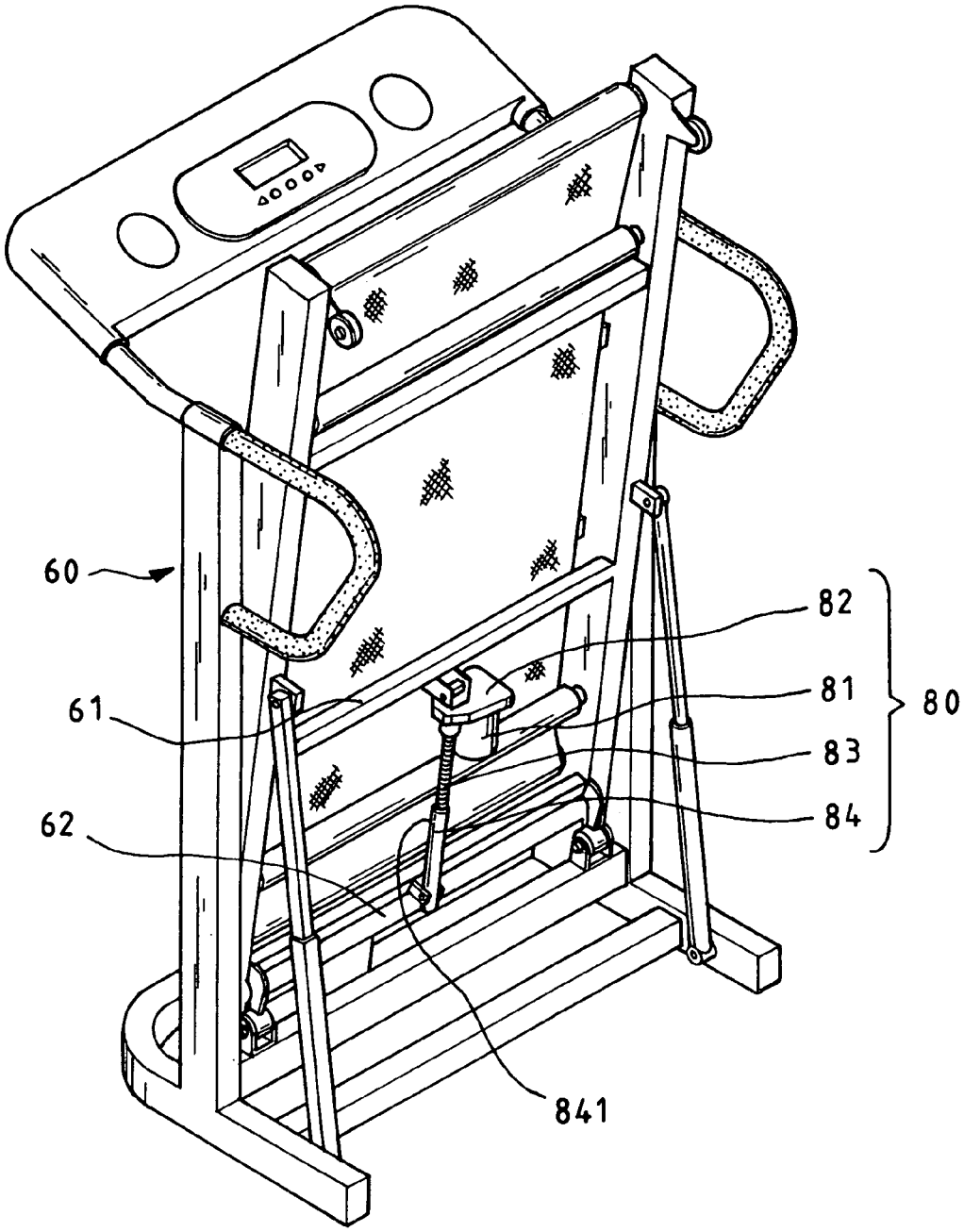
F I G. 1 PRIOR ART
FIG. 1 is a perspective view of a conventional lifting mechanism installed in a treadmill.
Figure 2:
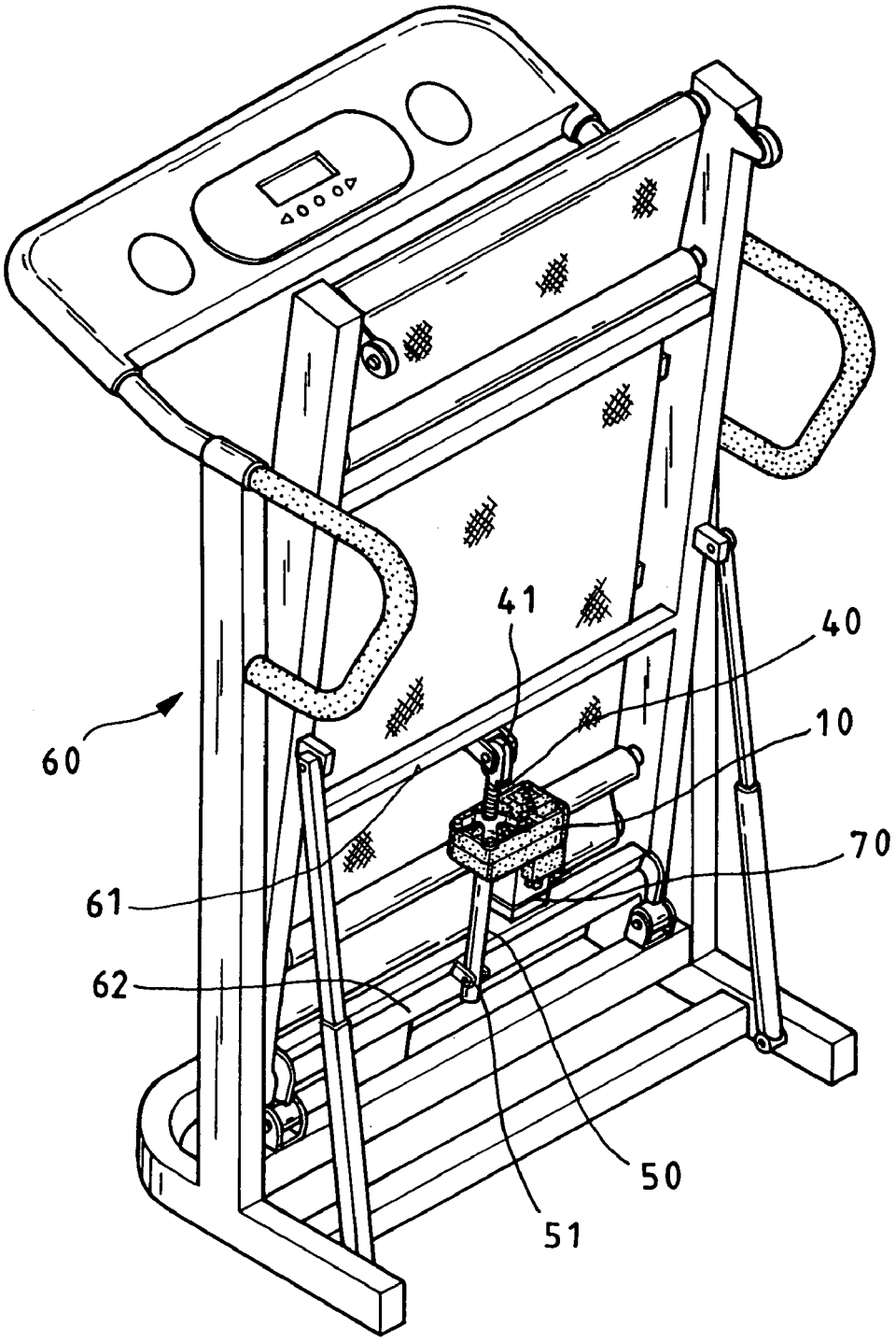
FIG. 2 is a perspective view of a lifting mechanism of the invention installed in a treadmill.

First of all, referring to FIG. 2, a treadmill 60 is illustrated. However, the installation of the lifting mechanism in accordance with the invention in other exercise apparatuses is also possible. In other words, the invention is applicable to any exercise apparatuses that require angle adjustment.

Figure 3:
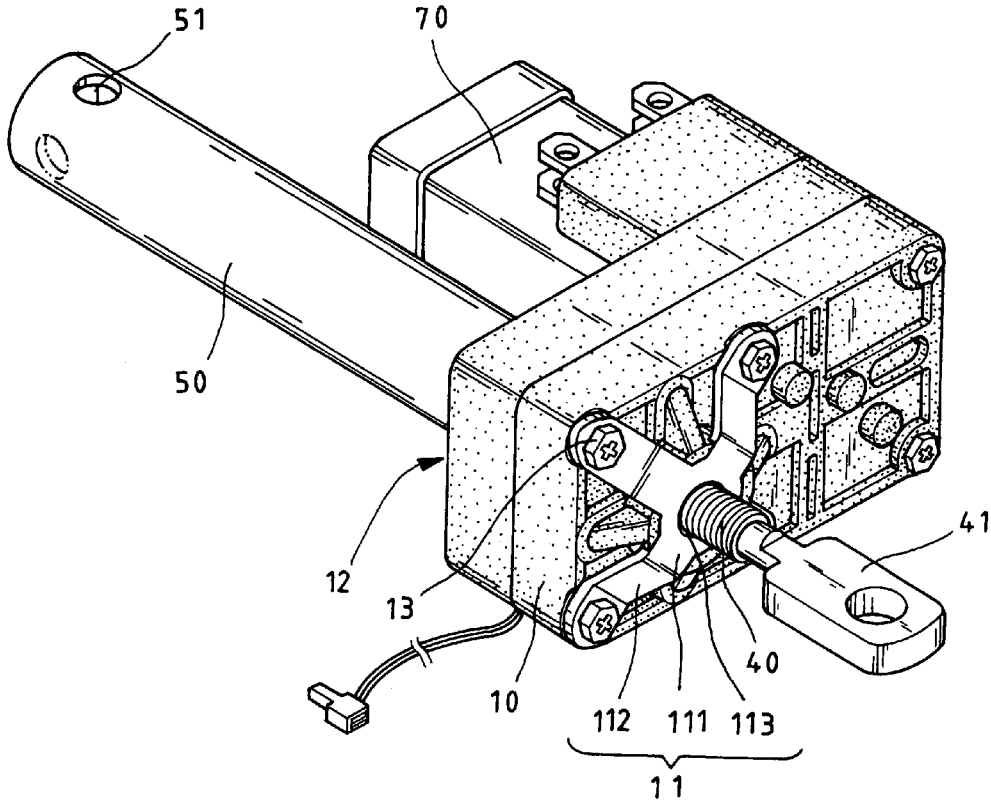
FIG. 3 is a perspective view of the invention after assembly.

As shown in FIG. 3, the lifting mechanism in accordance with the invention includes a housing 10 for accommodating a reduction gearset 20, a spindle 40 passing through one side of the housing 10. The spindle 40 is fitted with a head 41 at a front end thereof for facilitating the installation thereof. A socket 50 coaxial to the spindle 40 is disposed at a rear side of the housing 10 for the engagement of the spindle 40. The socket 50 includes a mounting hole 51 for installation in the treadmill 60. A motor 70 is installed at the same side of the housing 10 for providing torque to the reduction gearset 20 within the housing 10 (see FIG. 5).

Figure 4:
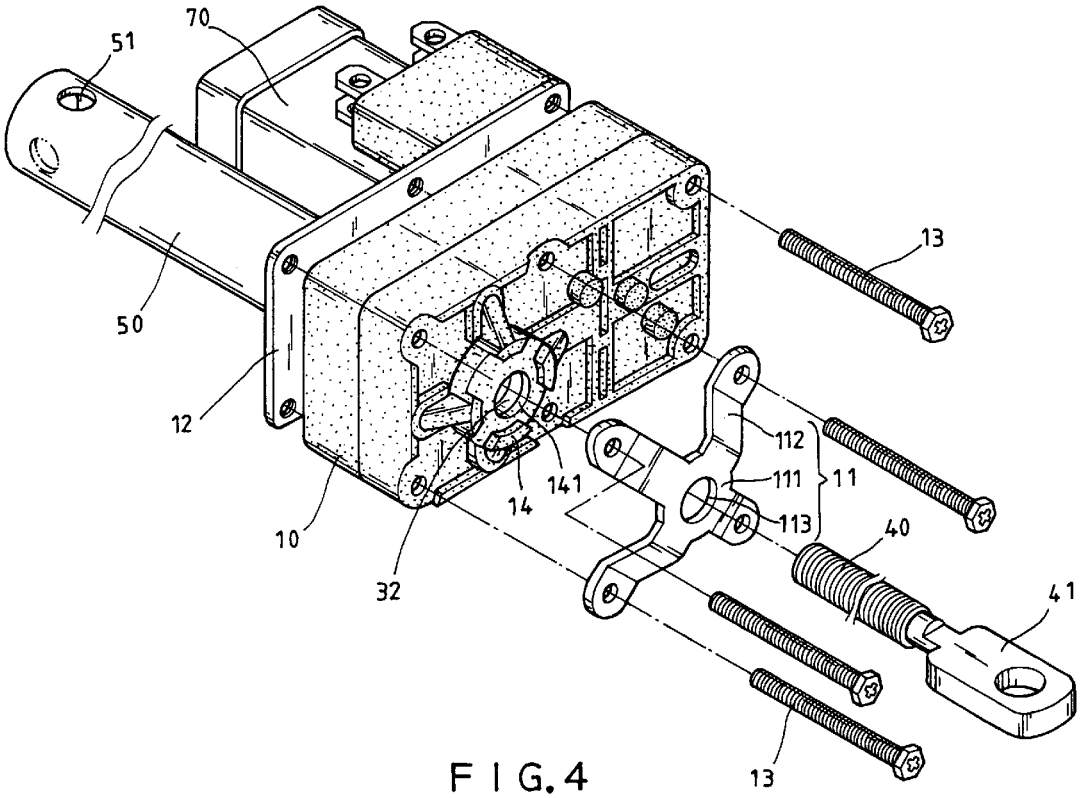
FIG. 4 is an exploded view of the invention.
Figure 5:
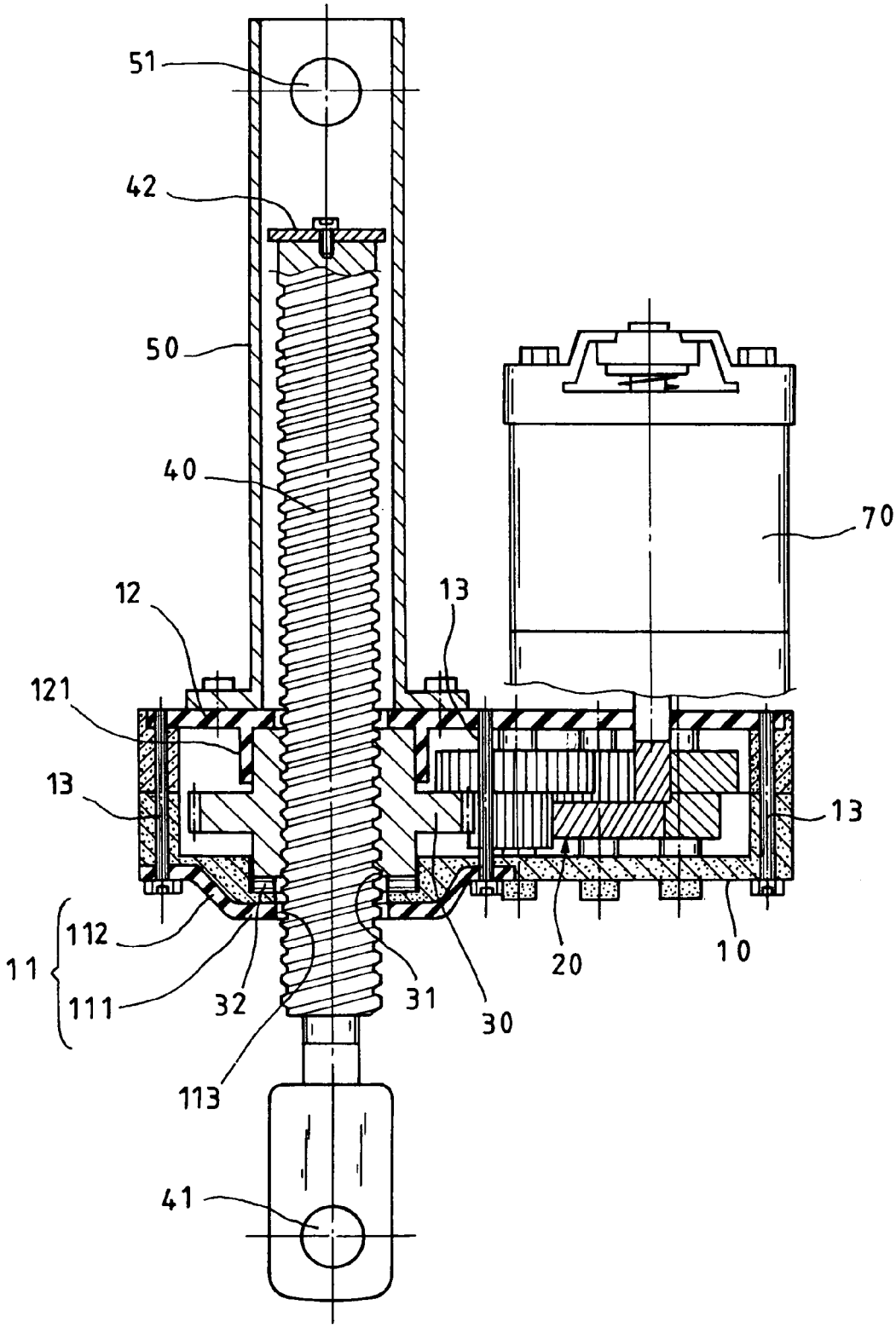
FIG. 5 is an axially sectional view of the invention.

As shown in FIGS. 4 and 5, the inside of the housing 10 includes the reduction gearset 20 and a driving gear 30 meshing with the reduction gearset 20. The driving gear 30 includes an axial threaded hole 31 and an axial bearing 32. The spindle 40 passes through the housing 10 and the axial bearing 32 and engages the axial threaded hole 31 of the driving gear 30. Meanwhile, the socket 50 corresponding to the spindle 40 is installed at the external side of the housing 10 to allow the telescopic motion of the spindle 40, but without contact therewith. Moreover, the spindle 40 further includes a stop piece 42 at a rear end thereof. The housing 10 is made of lightweight material as plastics, acrylonitrile-butadiene-styrene copolymer (ABS) and fabricated by an injection molding process. A first and a second piece 11, 12 for supporting the spindle 40 are made of high strength material as steel and fastened on both external sides of the housing 10 by metal screws 13, thereby forming a supporting frame with high strength.

In matching to a raised portion 14 of the housing 10, the first supporting piece 11 includes a raised middle portion 111 in addition to four downwardly extending claws 112. The middle portion 111 has a through hole 113 corresponding to an axial hole 141 of the raised portion 14. The raised portion 14 provides the installation room required by the driving gear 30. The second supporting piece 12 serves a side wall of the housing 10 and includes an annular portion 121 extending toward the inside of the housing 10 for fixing the driving gear 30 in place (see FIG. 5).

Based on the above-mentioned configuration, the invention can be used for adjusting the inclination of a tread base 61 of the treadmill relative to a horizontal plane. As shown in FIG. 2, the head 41 of the spindle 40 and the mounting hole 51 of the socket 50 are pivotally connected to the tread base 61 and a base frame 62 of the treadmill 60, respectively.

The adjustment of the inclination is achieved by means that the power of the motor 70 is transmitted through the reduction gearset 20 to the driving gear 30 such that the spindle 40 is extended or retracted relative to the socket 50 for changing the distance between the spindle 40 and the socket 50.

During the extending and the retracting action of the spindle 40, the spindle 40 remains unmoved. The supporting force acts through the driving gear 30 on two contact surfaces between the housing 10 and the driving gear 30. The first and the second piece 11, 12 are fastened on both external sides of the housing 10 by the respective metal screws 13, thereby forming a sufficient structural strength to withstand the load acting on the spindle 40. Meanwhile, the unloaded portion of the housing 10 can be made of lightweight material to reduce the whole weight of the housing 10. In this way, an easier movement is achieved and the material cost is reducible. Accordingly, the weight of the invention can be minimized and the strength thereof can be maintained to allow the spindle 40 both for being unmoved and for a linear telescopic action.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A mechanism for adjusting the inclination of an exercise apparatus comprising:

an exercise apparatus;

a) a housing made of lightweight material and fabricated by an injection molding process, the housing having a raised portion with an axial hole at a front side thereof;

b) a reduction gearset installed within the housing, the reduction gearset being driven by a motor at a rear side of the housing;

c) a driving gear installed within the housing, the driving gear meshing with the reduction gearset, the driving gear having an axial threaded hole corresponding to the axial hole of the raised portion of the housing;

d) a first supporting piece made of material with high strength for covering the raised portion of the housing, the first supporting piece having a raised middle portion and several downwardly extending claws, the middle portion having a through hole corresponding to the axial hole of the raised portion;

e) a second supporting piece made of material with high strength and installed at the rear side of the housing, the second supporting piece having an annular portion extending toward the inside of the housing for fixing the driving gear in place;

f) a spindle passing through the first supporting piece, the housing, the driving gear and the second supporting piece, the spindle meshing with the axial threaded hole of the driving gear, the spindle having a head at a front end thereof; and g) a socket mounted at a rear side of the second supporting piece to allow the telescopic action of the spindle within the socket, the socket having a mounting hole at the rear end thereof wherein the inclination mechanism is attached to the exercise apparatus via the head of the spindle at one end of the mechanism and the mounting hole of the socket at the other end of the mechanism.

2. The mechanism as recited in claim 1 wherein an axial bearing is mounted on the driving gear.

3. The mechanism as recited in claim 1 wherein the spindle includes a stop piece at a rear end thereof.

* * * * *